US005964013A

United States Patent [19]

Bergstrom

[11] Patent Number: 5,964,013

[45] Date of Patent: Oct. 12, 1999

[54] CABLE TIE WITH CABLE PROTECTION FEATURES

[76] Inventor: John A Bergstrom, 750 C. J. Moe Blvd., Dassel, Minn. 55325

[21] Appl. No.: 09/207,372

[22] Filed: Dec. 8, 1998

Related U.S. Application Data

[60] Provisional application No. 60/069,066, Dec. 9, 1997.

[51] Int. Cl.[6] ..... B65D 63/00

[52] U.S. Cl. ..... 24/16 PB; 24/17 AP; 24/30.5 P

[58] Field of Search ..... 24/16 PB, 17 AP, 24/30.5 P, 271; 248/74.3

[56] References Cited

U.S. PATENT DOCUMENTS

| | | | |
|---|---|---|---|
| 3,530,544 | 9/1970 | Burniston | 24/16 PB |
| 3,588,964 | 6/1971 | Dudley et al. | 24/16 PB |
| 3,983,603 | 10/1976 | Joyce | 24/16 PB |
| 3,996,646 | 12/1976 | Caveney | 24/16 PB |
| 4,008,512 | 2/1977 | Prodel | 24/16 PB |
| 4,009,509 | 3/1977 | McCormick | 24/16 PB |
| 4,011,633 | 3/1977 | Sail | 24/16 PB |
| 4,261,539 | 4/1981 | Albern et al. | 248/74.3 |
| 5,367,749 | 11/1994 | Takeuchi | 24/16 PB |
| 5,395,343 | 3/1995 | Iscovich | 24/16 PB |

*Primary Examiner*—Victor N. Sakran

[57] ABSTRACT

An improved cable tie for bundling wires, cables and the like having a band, head, spring section and retainer. The retainer is wrapped around the head and the band is inserted into an opening in the retainer and pulled until it meet the spring section. The band is then wrapped around the material to be bundled and then into the underside of the head and through the head. An interlocking device prevents the band from reversing its direction. The band is tightened until the installer feels the tension and the tightening of the spring section on the bundle. Cutting the retainer after installation will loosen the bundle by a controlled amount for tracking wires or subsequent removal.

5 Claims, 3 Drawing Sheets

CABLE TIE WITH CABLE PROTECTION FEATURES

This application claims benefit of provisional application No. 60/069,066 filed Dec. 9, 1997.

BACKGROUND

1. Field of Invention

The disclosed invention is an improved cable tie for forming a plurality of wires, cables or the like into a bundle having a spring section which enables the obtaining of correct tension and tightening of the bundle during attachment, loosening the cable tie by a measured amount after attachment, and to subsequently removing the cable tie easily and safely.

2. Description of Prior Art

Many industrial, commercial and residential buildings and offices have or need numerous wires, cables and the like for various electrical and electronic devices including telecommunications, computers, and security. These wires are frequently bundled together during installation in the ceilings, walls and floors. The wires and cables are insulated and any damage to the wire, cable or their insulation may affect the quality and quantity of the transmitted electrical signals. The electricians and installers of these wires and cables generally use cable ties to bundle the plurality of wires and cables and may bundle previously installed wires and cables.

Many building codes do not permit wire or cable or the like to lay on dropped ceilings and required the wires and cables and the like to be bundled and fastened to a building structure. To secure the bundle, cable ties are utilized not only for bundling but also for fastening the bundle to the building structure.

The standard cable tie in use today is a strap or band made of nylon or similar material. The end of the strap or band is wrapped around the wires to be bundled and then inserted into the head. It is tightened by pulling the band through the head. Various devices are utilized to hold the strap in the head as shown in U.S. Pat. No. 3,530,544 issued Sep. 29, 1970 for a Cable Binding Strap to Burniston, U.S. Pat. No. 3,983,603 issued Oct. 5, 1976 for a Tie for Bundling Items to Joyce, U.S. Pat. No. 3,996,646 issued Dec. 14, 1976 for Cable Tie and Method for Making Same to Caveney, U.S. Pat. No. 4,008,512 issued Feb. 22, 1977 for a Band Clamp of Plastics Material to Prodel, U.S. Pat. No. 4,009,509 issued Mar. 1, 1977 for Cable Ties to McCormick, and U.S. Pat. No. 4,011,633 issued Mar. 15, 1977 for Cable Band to Seil. In all of these applications, the installer fastens the strap around the plurality of wires, inserts the free end of the strap through the head and then pulls the free end of the strap. In so doing, the installer may over-tighten the strap, causing stress and damage to the wires or the insulation on the wires in the bundle.

At times, it is necessary for an installer to track a particular wire or cable in existing bundles. Tracking is required for a variety of reasons, including damage to wires, damage to insulation, or malfunction of an electrical or electronic device. With a standard cable tie, the installer must remove many or all of the existing cable ties to loosen the bundle so as to enable the tracking of the particular wire or cable. After tracking, the removed cable ties must be replaced.

The changing nature of the building and office environments by the use of new or additional electrical or electronic devices or requirements demands the addition of wires or the deletion of wires in existing bundles held together by cable ties. It is necessary to remove the existing cable ties. In cutting the existing cable ties as described in the above patents, the installer, even though careful, may damage wires or the installation on the wires in the bundle.

Thus, existing cable ties suffer from a number of disadvantages:

a. Over-tightening may result in damage to wires or insulation on the wires and cables in the bundle; and b. Loosing the cable tie for tracking purposes is not possible.

c. Removing the cable tie from a bundle may result in damage to the bundled wires and cables or insulation on the bundled wires and cables.

OBJECT AND ADVANTAGES

Accordingly, besides the objects and advantages of the cable tie described in my above patent, several objects and advantages of the present invention are:

a. To provide a cable tie which will protect against over-tightening the wires and cables in the bundle while it is being installed and yet allows the wires in the bundle to be secure and snug;

b. To provide a cable tie which will protect against over-tightening the wires and cables in the bundle while it is being attached to a building structure;

c. To provide a cable tie which may be loosened by a measured amount after it has been installed to avoid damage to the wires and the insulation on the wires;

d. To provide a cable tie which permits removal of the cable tie without damaging the wires or insulation on the wires in the bundle; and e. To provide a cable tie which may be loosened by a measured amount after it has been installed for tracking of wires in the bundle.

DRAWING FIGURES

FIG. 1 is the side view of the disclosed cable tie showing a head 1, a band 2, a retainer 3 and a spring section 4

FIG. 4 is the side view of the disclosed cable tie showing a typical use for bundling wires or cables or the like.

REFERENCE, NUMERALS AND DRAWINGS

1 head
2 band
3 retainer
4 spring section
5 shoulder

DESCRIPTIONS AND OPERATIONS—FIGS. 1 TO 4

Figure 1:
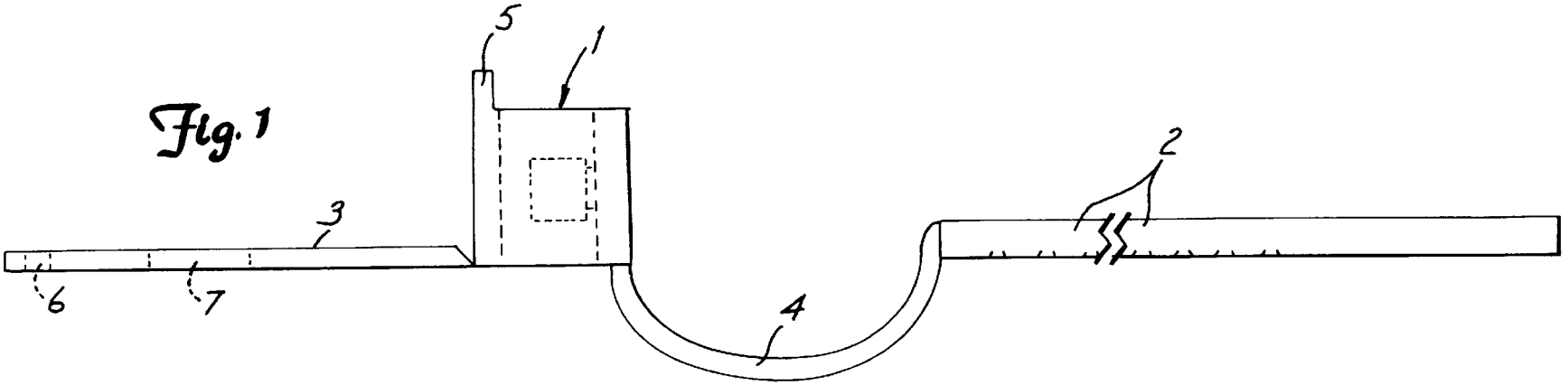
Figure 2:
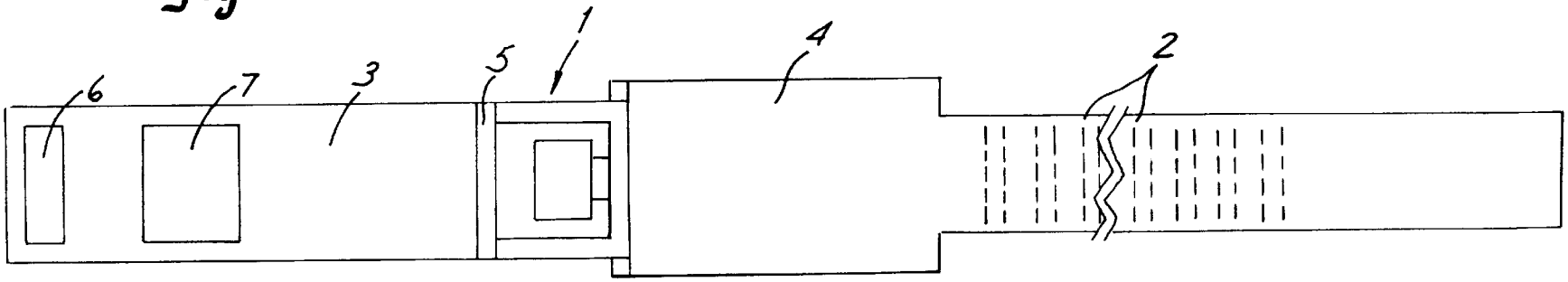
FIG. 2 is the top view of the disclosed cable tie showing all of the above parts and the hols in the head 1 and retainer 3.

A typical embodiment of the present invention is shown in FIG. 1, side view and FIG. 2, top view. The preferred material is a flexible nylon or plastic or any other material that may be bent without fracturing and with sufficient strength to prevent breaking when holding a plurality of wires, cables or the like. Generally, a cable tie of this kind is made by molding the material in a die.

The size of the present invention will vary depending on the number and types of wires cables or the like to be bundled, the material used and ease of manufacturing.

A band 2 is the portion of the present invention that wraps the wires, cables or the like into a bundle. Its shape is a substantially planar strip. One end thereof is free and the other end is attached to a spring section 4. The width and thickness of band 2 must be of sufficient size and strength to hold the bundle and easily inserted into a hole 6 of a retainer 3 and into a head 1. The length of band 2 must be sufficient to wrap around the desired wires or cable. It is anticipated that different length will be available for different usage.

Head 1 has attached to it a spring section 4 on the underside and retainer 3, both substantially in a planar shape. Although the drawings show the retainer 3 attached to the underside of the head opposite the side of the attachment of the spring section 4, it could just as easily be attached elsewhere, including the topside of head 1 in place of a shoulder 5. Shoulder 5 is simply to hold the retainer 3 away from head 1 so that the retainer may be cut easily when desired. The inner portion of head 1 contains some sort of interlocking device that prevents the reversing of band 2 after insertion into head 1. Such devise could be a pawl in the head with serrations on the band. The size of head 1 will be determined by the size of the cable tie, which is determined by the size and quantity of the items to be bundled and the strength of the material.

Spring section 4 helps the installer to obtain the correct tension on the cable tie by acting as a spring to relieve excess pressure on the wires in the bundle. The installer will feel the tightening of spring section 4 on the bundle as the installer pulls band 2 through head 1. Spring section 4 is attached on one side to the underside of head 1 and on the other side to band 2. The width and depth of spring section 4 is determined by the spring characteristics of the material and must be of sufficient cross section size to act as a stop when band 2 is inserted into hole 6 of retainer 3. If the width and depth of spring section 4 is not of sufficient size to act as a stop, another method could be utilized, such as an indentation at the juncture of band 2 and spring section 4. The length is determined by the size of the cable tie.

Retainer 3 is attached to head 1, as described above. Retainer 3 enables spring section 2 to act as a spring. Its length is determines by the size of the cable tie and the desired spring effect. Its width and depth are determined by the material used and must be of sufficient size to accommodate hole 6 and a hole 7. The part of retainer 3 between head 1 and hole 7 could be narrower to accomplish ease of cutting when loosening the cable tie by a measured amount. The size of the holes 6 and 7 must be sufficient to accommodate the cross section size of band 2. The size of hole 6 must be small enough so that it will provide a stop for spring section 4. Although the drawings show two holds 6 and 7 in retainer 3, holds 6 and 7 could be combined into one opening, which opening could be of any shape to accomplish its purpose.

Figure 3:
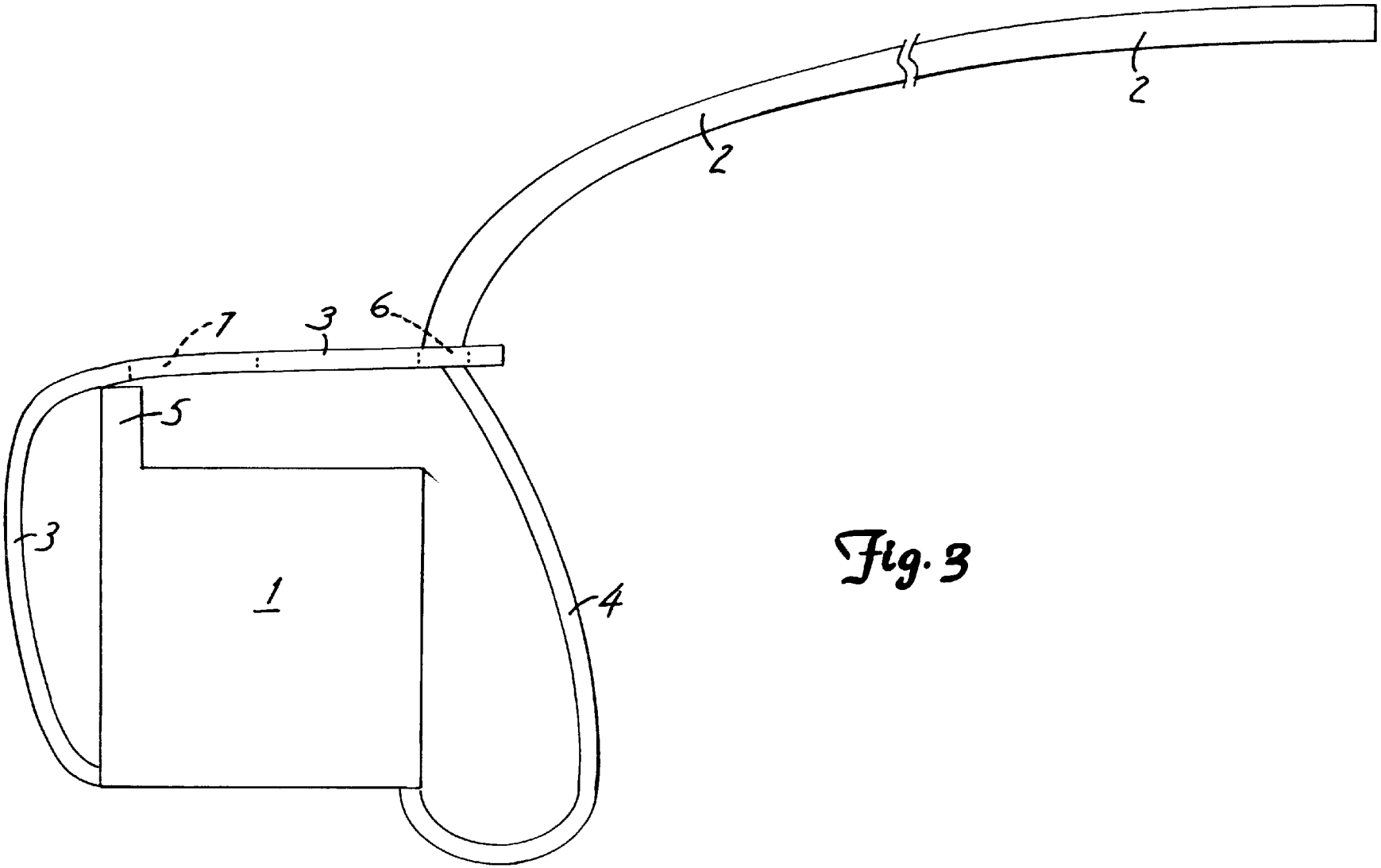
FIG. 3 is the side view of the disclosed cable tie ready for use.
Figure 4:
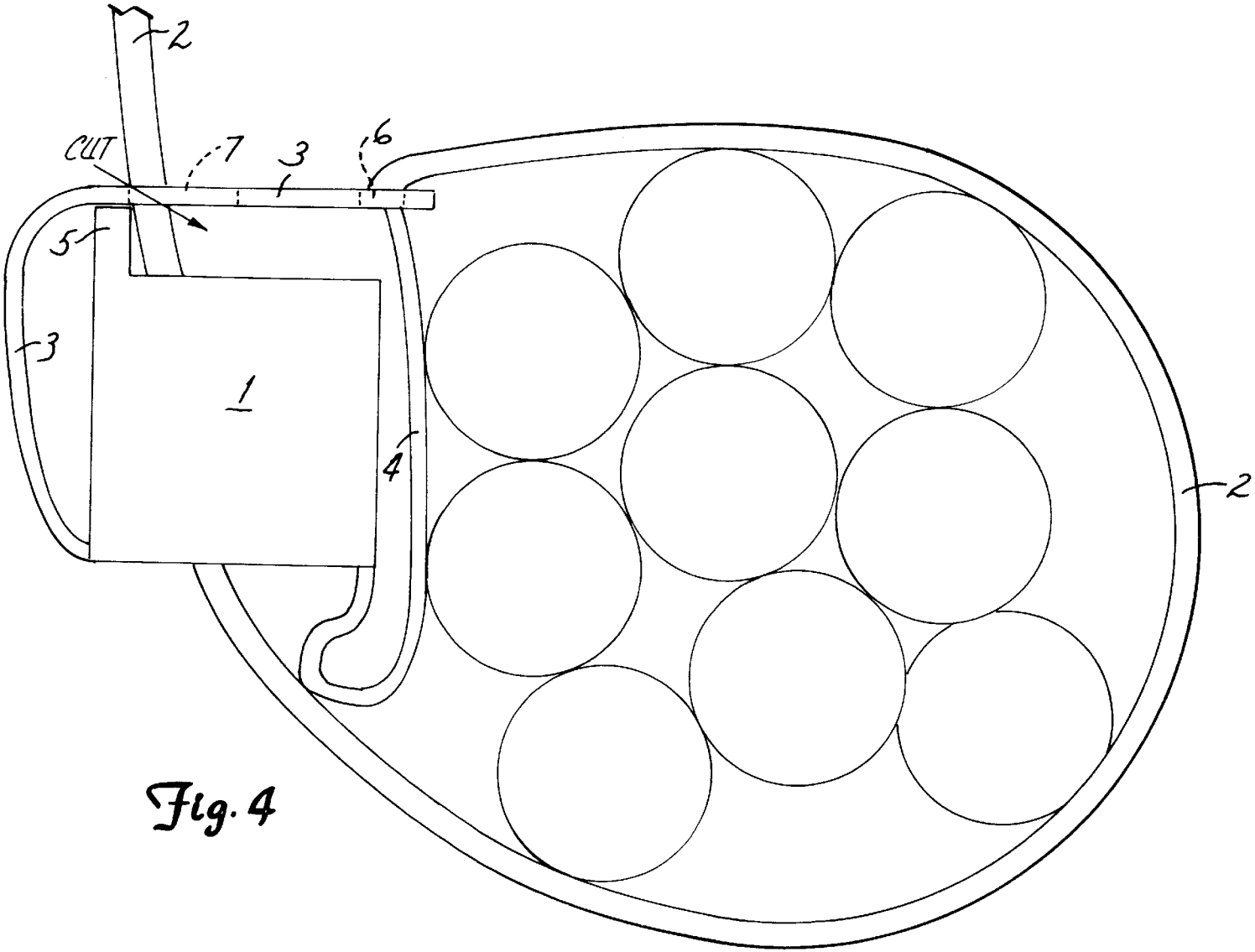

The typical use of the present invention is shown in FIGS. 3 and 4. Retainer 3 is bent around shoulder 5 so that the free end of band 2 may be inserted into hole 6 of retainer 3 and pulled until it stops at the junction between band 2 and spring section 4. It may be feasible in the manufacturing process to insert the free end of band 2 into retainer 3 so that this step would not be necessary by the installer. The cable tie is now ready for use. The free end of band 2 is wrapped around the materials to be bundled, such as wires, cables or building structures. This free end is then inserted into the underside of head 1 and thence into and through hole 7 of retainer 3. Band 2 is then pulled until the installer feels the tension and the tightening of spring section 4 on the bundle. The installation is complete. However, installers as a standard practice cut off the free end of band 2 that extends beyond head 1 and retainer 3. If the installer chooses, the same cut may be made to cut retainer 3, which has the effect of loosening the cable tie by a measured amount, yet still keeping the bundle secure.

If subsequently the installer wants to loosen the cable tie for tracking wires and retainer 3 has yet to be cut, the installer simply cuts retainer 3. This cut is easily made due to shoulder 5 and may be made anywhere along the length of retainer 3.

If subsequently the installer decides to remove the cable tie and retainer 3 has yet to be cut, the installer simply cuts retainer 3. Band 2 is now loosen and may be cut anywhere along its length.

Conclusion, Ramifications and Scope

Accordingly, the reader will see that the cable tie of this invention will protect the wires, cables and the like in the bundle from overtightening, thus preventing damage to the wires and insulation in the bundle and yet allows the wires and cables in the bundle to be secure. The invention facilitates tracking of wires and cables in bundles. The invention permits easy removal of the cable tie without damaging the wires in the bundle.

I claim:

1. A cable tie for bundling material, comprising (a) a substantially planar band having a free end at one end thereof and the other end attached to a spring section;

(b) said spring section attached on one end to said band and the other end to the insertion end of a head wherein said band is inserted;

(c) said head for inserting the free end of said band after bundling material and containing an interlocking device to prevent the inserted said band from reversal;

(d) a retainer attached on one end to the head, containing one or more openings for the insertion of said band, and the free end positioned on the head so that is located above the side of the head opposite the insertion of said band;

(e) the free end of said band inserted into an opening in said retainer to the junction of said band and said spring section, then wrapped around the material to be bundled, and then inserted into and through said head; and (f) Wherein said sprig section helps the installer to obtain the correct tension on the cable tie by acting as a spring to relieve excess pressure on the wires in a bundle.

2. The cable tie of claim 1 wherein the cross section of said spring section is larger that the cross section of said band.

3. The cable tie of claim 1 wherein the cross sections of said band and said spring section are the same with a stop at the junction of said band and said spring section.

4. The cable tie of claim 1 wherein the cross section of said spring section is smaller that the cross section of said band with a stop at the junction of said band and said spring section.

5. The cable tie of claim 1 wherein the head has a shoulder on the side opposite the insertion of said band.

* * * * *